United States Patent [19]

Waters

[11] Patent Number: 4,624,648

[45] Date of Patent: Nov. 25, 1986

[54] AERIAL TOY

[75] Inventor: John R. Waters, Lincoln City, Oreg.

[73] Assignee: Catch the Wind Kite Shops, Inc., Lincoln City, Oreg.

[21] Appl. No.: 748,181

[22] Filed: Jun. 24, 1985

Related U.S. Application Data

[63] Continuation of Ser. No. 747,364, Jun. 21, 1985, abandoned, and a continuation-in-part of Ser. No. 735,840, May 20, 1985, abandoned.

[51] Int. Cl.[4] ..... A63H 29/10

[52] U.S. Cl. ..... 446/176; 40/214; 73/189; 112/262.2; 112/262.1; 116/58 R; 116/264; 244/153 A; 273/360

[58] Field of Search ..... 446/34, 49, 54, 176, 446/211, 236; 40/214, 215, 217, 412, 413, 422; 73/188, 189; 112/262.1, 262.2; 116/58 R, 264, 265; 244/153 R, 153 A, 145, 152; 273/360, 361

[56] References Cited

U.S. PATENT DOCUMENTS

| | | | |
|---|---|---|---|
| 464,412 | 12/1891 | Ansboro | 244/153 R |
| 1,353,130 | 9/1920 | Ruff | 244/145 |
| 2,216,776 | 10/1940 | Hoffman | 273/360 |
| 2,238,876 | 4/1941 | Manson | 40/214 X |
| 2,243,618 | 5/1941 | Brown | 273/360 |
| 2,402,156 | 6/1946 | Griesinger | 273/360 |
| 2,524,500 | 10/1950 | Whitehurst | 244/153 R |
| 2,941,765 | 6/1960 | Feldman | 244/153 R |
| 3,086,738 | 4/1963 | Lubash | 244/153 A |
| 3,228,637 | 1/1966 | Gross | 244/152 |
| 4,194,652 | 3/1980 | Williamson | 112/262.1 X |
| 4,553,430 | 11/1985 | Behrens | 73/188 |
| 4,558,862 | 12/1985 | Kelly | 73/188 X |
| 4,561,301 | 12/1985 | Steele | 116/265 X |

FOREIGN PATENT DOCUMENTS

| | | | |
|---|---|---|---|
| 3236533 | 4/1984 | Fed. Rep. of Germany | 244/145 |
| 1541235 | 8/1968 | France | 244/153 R |

*Primary Examiner*—F. Barry Shay

*Attorney, Agent, or Firm*—Klarquist, Sparkman, Campbell, Leigh & Whinston

[57] ABSTRACT

A rotary aerial toy comprising a tubular sleeve of flexible material and of circular cross section. In one form of the invention the tubular sleeve tapers from one end toward the other with air entering the larger head end and moving toward the tail end. The head end is adapted for a bridle connection for supporting the sleeve for wind passage therethrough. The sleeve comprises plural strips extending at least generally longitudinally of the sleeve with each strip being of substantially right triangular form, at least at the head end portion thereof. The strips are connected to one another with the hypotenuse leg of one strip being connected to the altitude leg of an adjacent strip and with the base leg being transverse. The strips are arranged at assembly with a step between the head ends of adjacent strips and the seams connecting any selected pair of strips stop short of the head end of the altitude leg of the strip. The head end margins of the strips are secured to a ring to provide airchutes causing the tubular sleeve to rotate. In one form of the invention the strips are spiral along the length of the sleeve, whereas in another form, the strips extend essentially longitudinally of the sleeve. In a further form of the invention, the sleeve can be in the form of a cone. In still another form, the sleeve can be a cylinder. The application also covers the method of producing the above rotary aerial sleeve toys. In a further form, the strips are secured together to form a ringless sleeve. In another form the strips have integral bridle line portions whose free ends are connected by a fastener.

12 Claims, 13 Drawing Figures

AERIAL TOY

This application is a continuation-in-part of my prior application, Ser. No. 735,840, filed May 20, 1985, abandoned, entitled "Aerial Sleeve Toy". This application is a continuation of my prior application, Ser. No. 747,364, filed June 21, 1985, abandoned entitled "Improved Aerial Sleeve Toy." Benefit of the filing dates of such applications is claimed under 35 U.S.C. 120.

This invention relates to aerial toys.

Hand held toys, rotated when moved through the air or subject to wind forces, are generally known. Typically they are equipped with either a propeller or a series of individually curved elements mounted for rotary movement and caused to rotate by the passage of air therepast.

A more recent version of the latter type is referred to in the trade as a "basket." It comprises cloth or cloth-like sections formed and secured so that each, when subject to wind forces, provides sufficient circumferential force components that collectively they cause the basket to rotate.

Also, there has been relatively recently introduced into the United States, a decorative flexible sleeve having a head end for air entry and a tail end for air exit, the tail end having streamers so that when the sleeve is suspended out of doors, gusts of wind will blow through the sleeve and agitate the streamers, making a pretty show. This sleeve is not intended nor constructed to rotate.

While not considered a toy or decorative item, the wind sleeve at an airport should be mentioned. It is mounted so that wind can bodily turn it to a position aligned with the direction of wind flow, to provide this information to pilots of aircraft. It is not intended, nor can it, rotate about is own axis.

The primary purpose of the present invention is to provide a wind sleeve so constructed that it will be rotated by the passage of wind therethrough.

In one preferred embodiment, the sleeve is composed of plural generally longitudinal extending strips of generally right triangular form, with the altitude legs extending generally lengthwise, while the base margins are transverse and are secured to a ring. Considering the strips as arbitrarily being in pairs, any one pair will have the altitude leg of one strip seam-secured to the hypotenuse leg of the other, with the altitude leg terminating short of the hypotenuse leg at the head end of the sleeve. The seams stop short of the head end of each altitude leg to provide a vent for any selected pair, wherein the vent is defined in part by an airchute portion which, when air passes therethrough, provides a circumferential component force to the sleeve urging it to rotate.

The term "generally longitudinally" is meant to include both the true longitudinal direction as well as a spiral configuration.

In another preferred form of the invention, and considering any selected pair of strips, the two strips are offset longitudinally to increase the size of the step at the head end of the strips. This feature causes the strips, when assembled, to be disposed in a spiral form down the length of the sleeve, lending a much superior decorative appearance, particularly when rotating.

In a further preferred form of the invention, the sleeve is cylindrical and the strips are essentially rectangular but are so joined and formed at their head ends as to provide airchute portions for effecting rotation.

An object of the invention is to provide a sleeve-like toy in which the strips are arranged in spiral form, in such a manner as to cause the sleeve to rotate in the direction of the spiral.

In a still further preferred form of the invention, the strips have integral bridle portions which are assembled in a novel manner.

In still another preferred form of the invention, the bridle steps and the swivel clip are connected together in stacked fashion by a "Swiftach" connection.

In a preferred method, strips are assembled in a novel manner utilizing a welting foot.

DESCRIPTION OF THE PREFERRED EMBODIMENT

Figure 1:
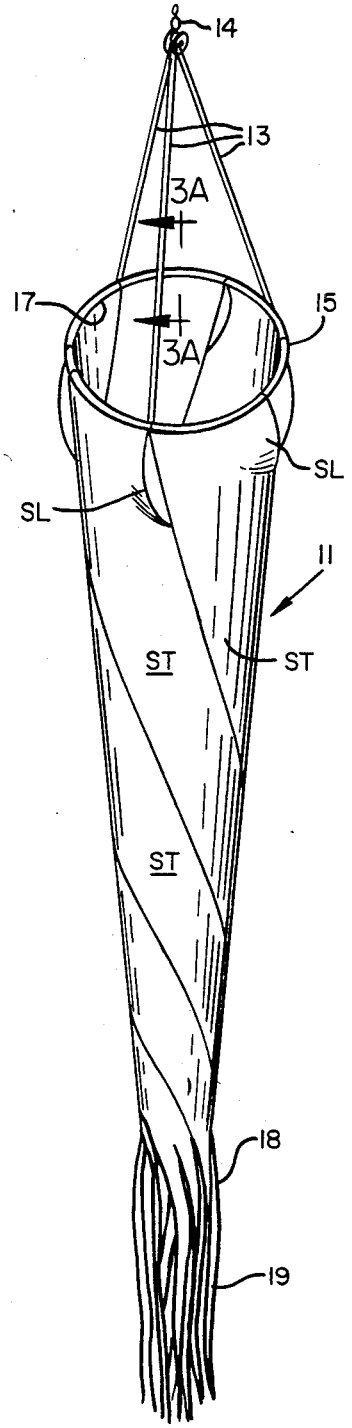
FIG. 1 is a view of an aerial toy of the present invention.

FIG. 1 shows a wind sleeve 11 which is tapered from its head end toward its tail end, and is of circular cross section when in use. The sleeve is equipped with a bridle 13 having a swivel clip 14 by which it may be mounted on a stick, for hand held uses, or otherwise mounted for exposure to wind forces.

The sleeve has a head end 15 providing a mouth 17 for entry of air. It has a tail end 18 for exit of air, such tail end having streamers 19, if desired. For reasons to be explained hereinafter, when the sleeve is subjected to the passage of wind, it will cause the sleeve to rotate, which is permitted by the swivel clip 14.

The sleeve is preferably made of cloth or cloth-like material, such as for instance Rip-Stop Nylon.

The sleeve comprises plural strips ST spiralling down the length of the sleeve. The strips ST shown are identical in shape (although variations from that are possible as may be indicated hereinafter).

Figure 3A:
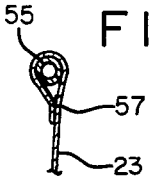
FIG. 3A is a fragmentary sectional view taken along line 3A—3A of FIG. 1.
Figure 3:
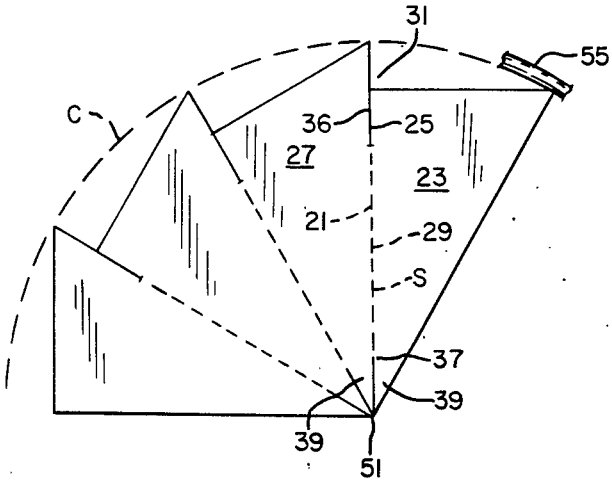
FIG. 3 is a schematic view showing an assembly step of several strips.
Figure 4:
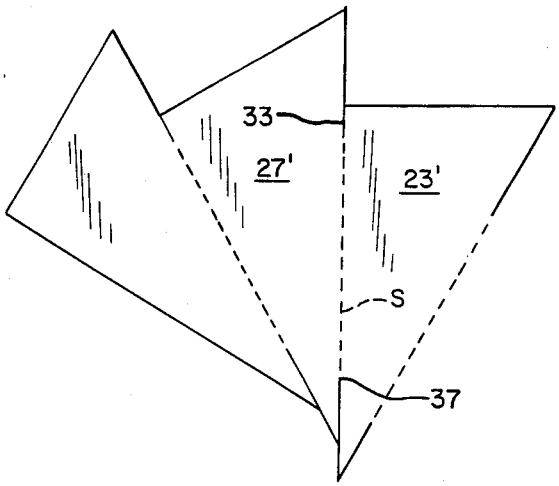
FIG. 4 is a view like FIG. 3 but showing an assembly step for providing a device like in FIG. 1.

FIG. 3 and FIG. 4 show various strips and an indication of the manner in which they are assembled. The strips are shown as being of rather squat form, rather than being elongate in the direction of their altitude legs. Commercially, the great majority of sleeves, and thus the strips, will be elongate, rather than squat. However, the relationship of the parts can be most easily understood by showing squat strips. This does not mean that an operational sleeve could not be produced with the dimensions of FIGS. 3 and 4. It only means that the resulting structure would not from the commercial standpoint be particularly attractive and would not be therefore a good seller.

To give an idea of the commercial proportions, the angle between the altitude and the hypotenuse in FIGS. 3 and 4, would be more likely in the range of 10 to 20 degrees, rather than as shown. In some examples, the angle is even less. In a few, it is more.

Figure 7:
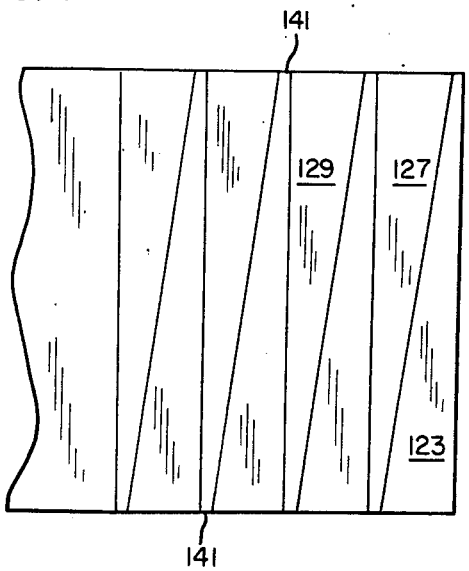
FIG. 7 is a layout view of truncated right triangular strips.

In most of the commercial models presently being produced by my employer, the strips are of truncated right triangular form, (such as shown in FIG. 7), rather than being of exact right triangular form. However, the strips could be of right triangular form. For ease in disclosure, the invention will be first described with the strips being of right triangular form, with it being understood that variations in that form may be made.

Figure 2:
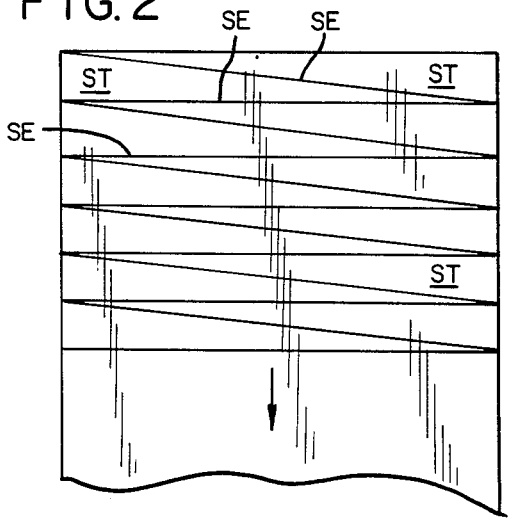
FIG. 2 is a view of certain strips in their formative stage.

FIG. 2 shows a block of fabric which has been shown cut with sever lines at SE to form plural pieces P of identical right triangular configuration.

Now, to assemble the strips, reference is made to FIG. 3. It shows several strips arranged in what can be termed serial fashion with the altitude leg 21 of one strip 23 being disposed in contact with the hypotenuse leg 25 of the strip 27 adjacent such altitude leg. The margins at the altitude leg 21 and hypotenuse leg 25 are joined together such as by stitching 29 to provide a seam S.

Note that the head end of strip 23 terminates short of the head end of the hypotenuse leg of strip 27 to provide a step 31. Note also that the seam S, at the head end of the seam, stops at point 35 to provide a vent 36 between the head ends of strips 23 and 27. The seam S also stops at 37 to provide streamer portions 39.

Note that in FIG. 3, the tail end extremities of the strips meet at a common imaginary axis 51, while the head ends of the hypotenuse extremities 53 fall along a circle C having its axis at 51. For convenience, the circle C is shown as being provided by a ring 55 to which the strips are to be secured. In practice, the ring would have a slightly smaller radius than that shown in FIG. 3.

In further assembly, the head end of the strip 23 is moved by rotating it clockwise about its right corner into a chordal relationship with the ring, and then moved radially of the ring past such relationship, so that the head end margin overlaps the ring. The margin is then wrapped over the ring 55, such as shown in FIG. 3A, and seamed back to itself at 57, such as by a sewing or other convenient operation. Strip 27 is similarly moved and secured to the ring. When this occurs, a slack zone SL such as shown in FIG. 1 is created, forming an airchute having a maximum billow or radius (in the plane of the paper) at the vent, tapering over circumferentially in a decreasing fashion toward the altitude leg of the triangle 27.

Since strip 23 will have its hypotenuse similarly secured to the altitude leg of the strip next clockwise to it, a billow or slackness SL in strip 23 would be similarly provided.

Thus air entering a sleeve (formed as above described), increases in pressure because of the tapering of the sleeve. It seeks to escape and will in part do so through the airchutes provided at the slackness zones. This creates circumferential force components to rotate the toy counterclockwise as the parts are shown in FIG. 3.

If the aerial sleeve toy were produced following the teachings of FIG. 3, the strips would extend longitudinally of the sleeve rather than in a spiral fashion as shown in FIG. 1. While either form is within the scope of the present invention, the spiral form is believed to have the most attractive appearance commercially.

In assembly of the FIG. 3 form of the invention, a sewing machine with a bead presser foot is utilized and the margins of an already assembled set of strips are successively applied around and seam connected to the ring which itself is accommodated by the bead type presser foot.

FIG. 4 shows an arrangement like FIG. 3, but wherein strip 23' is shifted down and thus offset longitudinally with respect to the strip 27'. This means that the tail end extremities of the two triangles do not coincide at a common axis, but are offset from one another. Also the extremities of the hypotenuse legs at the head end of the strips no longer fall on a circle with a common axis as in the case of FIG. 3. Note, however, that FIG. 4 does have in common with FIG. 3, a seam S between the strips, with the seam terminating short of the ends of the altitude leg of the strip 23' to provide a vent 33 at the head end, and a separation at 37 at the tail end.

The steps at assembly are similar to that described above for FIG. 3, with the head ends of the triangles successively brought into a chordal relationship to the ring and then placed in overlapping relationship to the ring with the margins sewn back to the body of the strips to mount the strips on the ring. Now, however, because of the longitudinal offset between the strips, the strips spiral lengthwise of the sleeve, rather than extending longitudinally along the sleeve, as is the case in connection with a sleeve produced in accordance with the teachings of FIG. 3.

The spiral sleeve resulting from the assembly according to FIG. 4 would look like FIG. 1, were the strips of FIG. 4 more elongate (as are the strips in FIG. 2).

Figure 5:
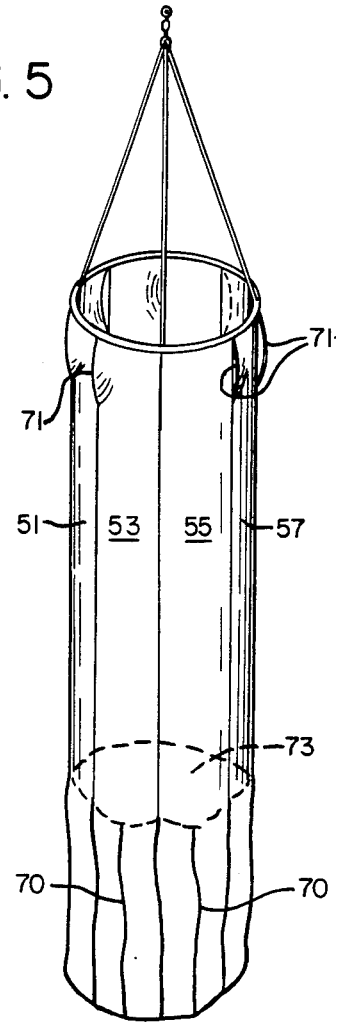
FIG. 5 is a view of an aerial toy of the present invention of cylindrical form.
Figure 6:
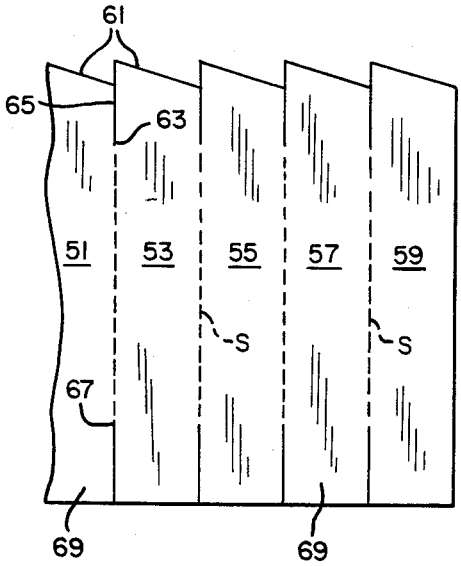
FIG. 6 is a layout of the sleeve of FIG. 5 in its formative stage.

In still another form of the invention, the sleeve is cylindrical as shown in FIGS. 5 and 6. The strips 51, 53, 55, 57 and 59 are essentially rectangular but have oblique head ends 61. FIG. 6 indicates that there is a seam S between each pair of rectangular strips with the seam stopping short at 63 of the head ends of the strips to provide a vent 65. The seam also stops at 67, which is short of the tail ends of the strips to provide tail portions 69, which are shown as being short, whereas in the actual construction they will be of considerable length. They may be further divided by cuts 70, FIG. 5.

The oblique head ends 61 are secured to a ring, using steps similar to those recited in connection with FIG. 3, to form an airchute at 71 for each of the strips. The airchute, in the case of FIGS. 5 and 6, tapers in radial depth from left to right, rather than right to left as is the situation in connection with FIG. 1 (or FIG. 3), so the FIG. 5 toy rotates in the opposite direction than the one in FIG. 1. If the cuts forming the oblique ends 61 were opposite from those in FIG. 6, then the airchutes would be opposite, and thus the toy would rotate in the same direction as the FIG. 1 toy.

Means are provided for restricting the free flow of air through the cylindrical sleeve. FIG. 5 shows an obstructing piece 73 secured within the sleeve. The piece 73 can entirely or only partially obstruct the passage through the sleeve. In any event, it causes a build up of air pressure within the sleeve. Air escaping through the airchutes causes the sleeve to rotate.

The FIG. 5 form of the invention lends itself to being produced from pastic sheets (such as polyethylene), as well as from cloth.

FIG. 7 shows in layout form a number of strips 123, 127, 129, etc., in layout form, i.e., in the positions they occupy at the time of severing a pile of cloth sheets into strips.

Note in this instance, that the triangles each have a truncated end 141. This has proved, for my employer, a very practical and satisfactory way of forming the strips. The only difference between a sleeve assembled from strips such as shown in FIG. 7 and the ones which would be formed from strips such as in FIGS. 3 and 4, is that the tail ends of the strips would be truncated, rather than tapering to a point.

It is evident that the direction of rotation of the sleeve is wholly dependent upon the way the pieces are assembled. For instance, if the strips 27 and 23 in FIG. 3 were flipped 180 degrees, then the direction of rotation of the sleeve would be the reverse of the sleeve produced in accordance with the teachings of FIG. 3.

While the description has referred to a right triangular form, and a right triangle is the preferred form of invention, the angle need not be an absolute 90 degrees, but substantial deviations from 90 degrees do not result in a particularly satisfactory product, although of marginal utility.

A similar observation can be made with regard to the FIGS. 5 and 6 form of the invention.

Again, with reference to FIGS. 3 and 4, a seeming variation of the construction would be to insert what might be considered as rectangular insert strips along one edge or the other of the right triangle so that in a theoretical sense the construction would seem to be other than of a right triangular form, arguably made up of right triangular plus small rectangular strips. In essence the rectangular strip would be a simple extension of the triangular strip.

A further version of the invention comprises a sleeve with a closed lower end, i.e., a sleeve which turns out to be a cone, thus with the seam S in FIG. 3 extending all the way to the extremities at 51 eliminating the break at 37. While the cone construction is interesting, it has not proved as commercially acceptable as has the tapered sleeve construction.

While the embodiments of the invention disclosed herein have been called "toys", this is not meant to rule out practical use of devices incorporating the concepts of the present invention. For instance such a device could be used for detecting wind speed. This is particularly true in regard to spiral sleeves. For instance, assume that a spiral sleeve has one of the strips of a distinctive color. Upon rotation, the color appears to travel down the length of the sleeve and, at a pulse rate proportional to the speed. By mentally counting "pulses", or noting the number of them, one can determine the speed of rotation.

For commercial purposes, spirals of different colors have proved most popular. One arrangement could include the colors of the spectrum, disposed in their proper order.

While it is conceivable in assembly to use a completed ring 55, in practice assemblers may find it more convenient to use a strip of hollow plastic material to which the margins of the strips are joined and which later has its ends connected.

While the invention has been explained with sleeves having rigid rings, soft rings or even a tape may be employed. In fact it is possible to eliminate the ring, and to connect seam-connected strips to a bridle to provide a unit that will rotate, once wind has the opportunity to enter and open up the sleeve (assuming it is not already open a sufficient extent to provide for entry of air).

Now referring to FIGS. 8 through 13, a modified form of the invention is there disclosed, which might be termed the integral bridle arrangement. This arrangement could be used on any of the shapes of sleeves, frustoconical, conical or cylindrical.

In the FIG. 1 form of the invention, a separate bridle 13 was provided. In the FIG. 8 form of the invention, the bridle lines 213 constitute integral portions of the strips themselves. The upper or free ends of these integral bridle lines are connected together, along with a swivel clip 14, by means of a "Swiftach" connection 215.

Figure 9:
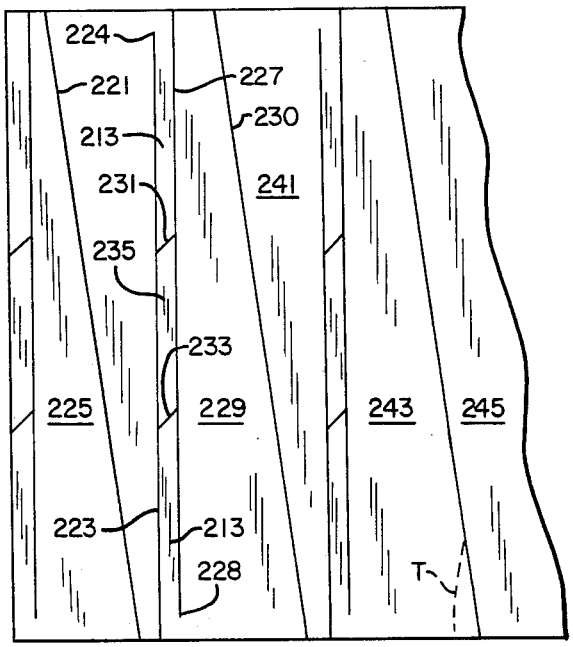
FIG. 9 is a view, on a reduced scale, of strips of FIG. 8 in their formative stage.

Now, more in detail, reference is made to FIG. 9, which shows a sheet of flexible material such as Rip-Stop Nylon, which is cut into sections by plural sever lines. These include a sever line forming the hypotenuse 221, and a sever line 223, which terminates short of the top edge of the sheet of material at 224 and defines the altitude of a frusto-triangular section 225. A sever line 227, which terminates at 228 short of the bottom edge of the sheet of material, defines the altitude of a second frusto-triangular section 229, whose hypotenuse is formed by a sever line 230. Oblique sever lines 231 and 233 define the ends of bridle line 213 for the sections. There is a small wastage section 235 which is simply discarded. The lines 231 and 233 could be transverse rather than oblique.

Other sections such as 241, 243, 245, etc., are similarly formed. The term "section" rather than "strip" is used purely as a matter of form, and in case it is later desired to refer to the "lines" 213 as strips.

While a sleeve could be produced from sections having the proportions shown in FIG. 9, typically the proportions would be those of a more elongated triangle.

Figure 10:
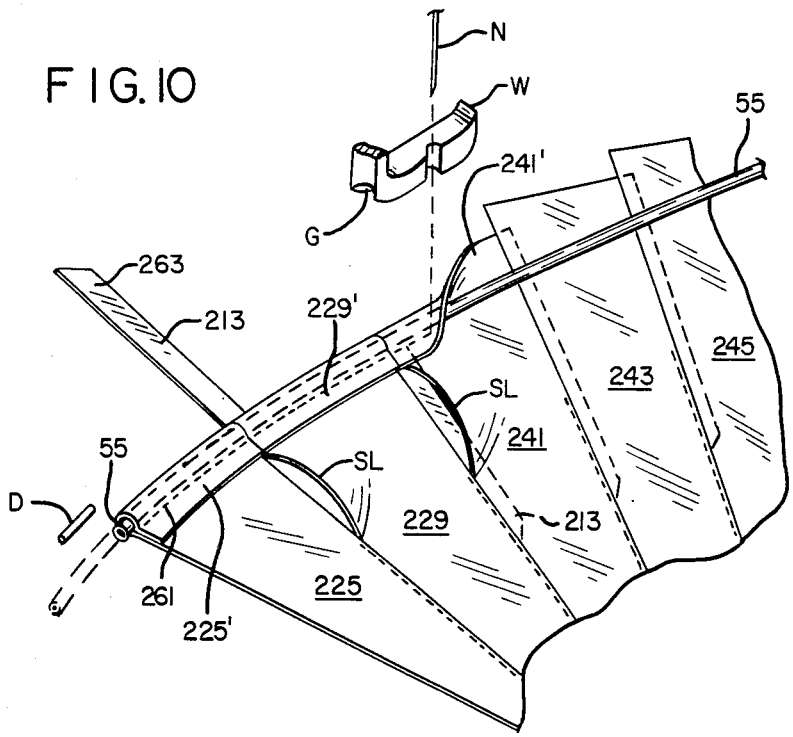
FIG. 10 is a perspective view showing certain of the steps in assembling the FIG. 8 form of the invention.

Prior to the FIG. 10 step, the margins of adjacent sections will be overlapped (as described in connection with either FIGS. 3 or 4) and joined together by longitudinal seams S wherein the seams stop short of the leg-ends (as shown in FIGS. 3 and 4). The sewing step is carried out with the bridle lines moved out of the way and free of the seams S.

Now, as shown in FIG. 10, the partially assembled sleeve in flat form, and with the bridle lines now back in their juxtaposed positions, is laid on the sewing table (not shown) of a sewing machine (not shown). Each bridle line will underlie the body portion of the adjacent section (compare sections 241, 243 and 245). The head ends of the sections will be staggered as shown for sections 241, 245.

The sewing machine (not shown) has a welting foot, such as at W, the foot being of conventional construction and having a groove G on its underside, the foot cooperating with a needle N to enable providing a welt at the mouth of the sleeve.

The hollow plastic tube 55 is laid against the upper margins of the head ends of the sections. The head end portions of the sections are successively brought into alignment, to form the slack or billow zones SL, and are successively looped around the hollow plastic tubing 55. The material then is progressively passed underneath the welting foot, concurrent with needle operation. This provides a threaded seam at 261, to firmly secure the sections to the tubing 55.

After the above steps, the bridle line portion 213 for each section can be moved to an upwardly extending position, as shown for the bridle line portion of section 225.

Figure 11:
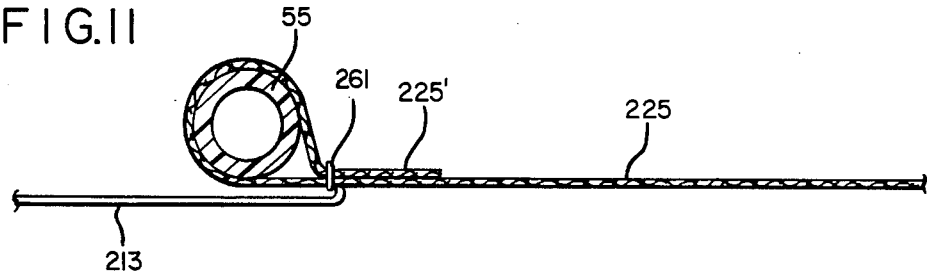
FIG. 11 is a sectional view showing an assembled strip of the modified form of the invention.

Reference is made to FIG. 11 to show the relationship of the main portion of a section and the related bridle line portion 213, the strip shown being assumed to be strip or section 225.

After all of the sections have been joined to the ring, two further things need to be done. A seam is then formed between the free side edges of the end sections. Then a dowel pin D is forced into the opposite ends of the hollow tube, and by either the force fit and/or adhesive secures the free ends of the tube 55 together to form a ring.

Figure 12:
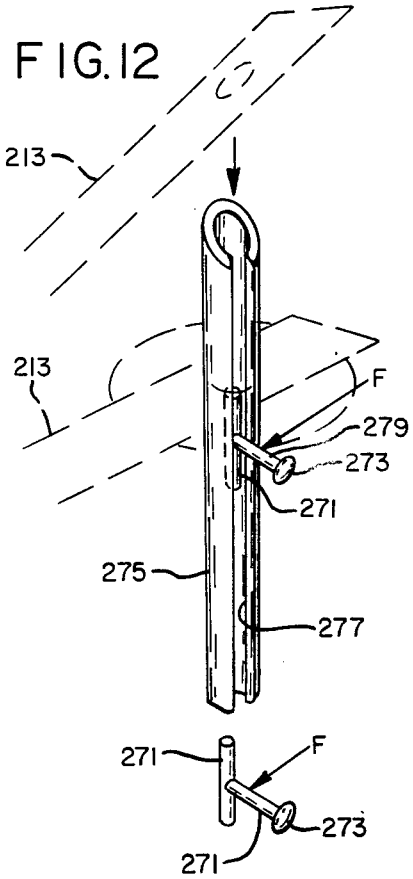
FIG. 12 is a fragmentary perspective view showing a step in the securement of the bridle portions together by a "Swiftach" fastener.
Figure 13:
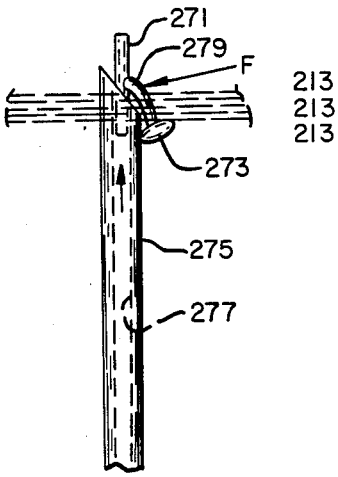
FIG. 13 is a subsequent step in such securement.

The free ends of the bridle lines 213 are formed at the cutting stage each with a hole such as at 263 for the bridle line for strip or section 225. A convenient and inexpensive way of securing the free ends of the bridle lines together comprises the "Swiftach" system sold by Dennison Manufacturing Company. In the "Swiftach" system, plastic fasteners F such as shown in FIGS. 12 and 13 are utilized. The particular connector shown is known as the button type, having a T-bar shape 271 at one end and a button 273 at the opposite end.

The Swiftach system uses a tool (not shown) having a hollow needle 275 which has a slot 277. The hollow formed in the needle is of a size to receive the bar 271 while the slot passes the shank 279 of the fastener F. The needle 275 is threaded through the holes 263 of the bridle line ends (which are to be fastened together), along with a ring of a swivel clip 14, the whole being flanked by plastic washers 276. Thereafter the Swiftach tool is actuated to drive the bar through the openings 263 to locate the bar 271 on one side of the stacked ends and washers and the button 273 on the other. With this simple procedure, a bridle of simple and inexpensive form is provided.

Returning now to FIG. 10, note that when the side margins of the sections are overlapped and sewn together by the seams S, this will provide an overlap at the margins 225', 229' and 241'. If desired, this overlap can be eliminated by laterally truncating each section, as shown at T in FIG. 9, so that the sewer need not be concerned about the natural overlap that would otherwise occur.

The term "triangle" is meant to cover not only sections or strips of true triangular form, but also those that are basically or essentially triangular, i.e., ones that are truncated, or that have integral bridle lines, or those where the base is other than at 90 degrees to the altitude, etc.

It is pointed out in connection with all of the forms of the invention that in production, tag marks, in the form of perforations, will be utilized to guide the assembler as to where to move the various portions of the strips for sewing, connection, side seaming and the like. At the same time that the tag marks are formed, a tag mark or hole 263 is provided at the free end of each bridle line or ribbon to readily enable Swiftach fastening.

The reference in the foregoing description to Swiftach fastening is not intended to limit the invention to connection in this fashion, although that approach has substantially reduced assembly costs and made a product much less expensive than would otherwise be the case.

In a basket toy, an improvement comprises fastening the tail ends of the sections together with a Swiftach fastener. The tail ends are preferably each provided with a tag hole, to facilitate threading them onto a Swiftach needle, along with flanking washers. Then the Swiftach tool is operated to secure the ends together with a Swiftach fastener, such as the button type shown in FIG. 12.

Figure 8:
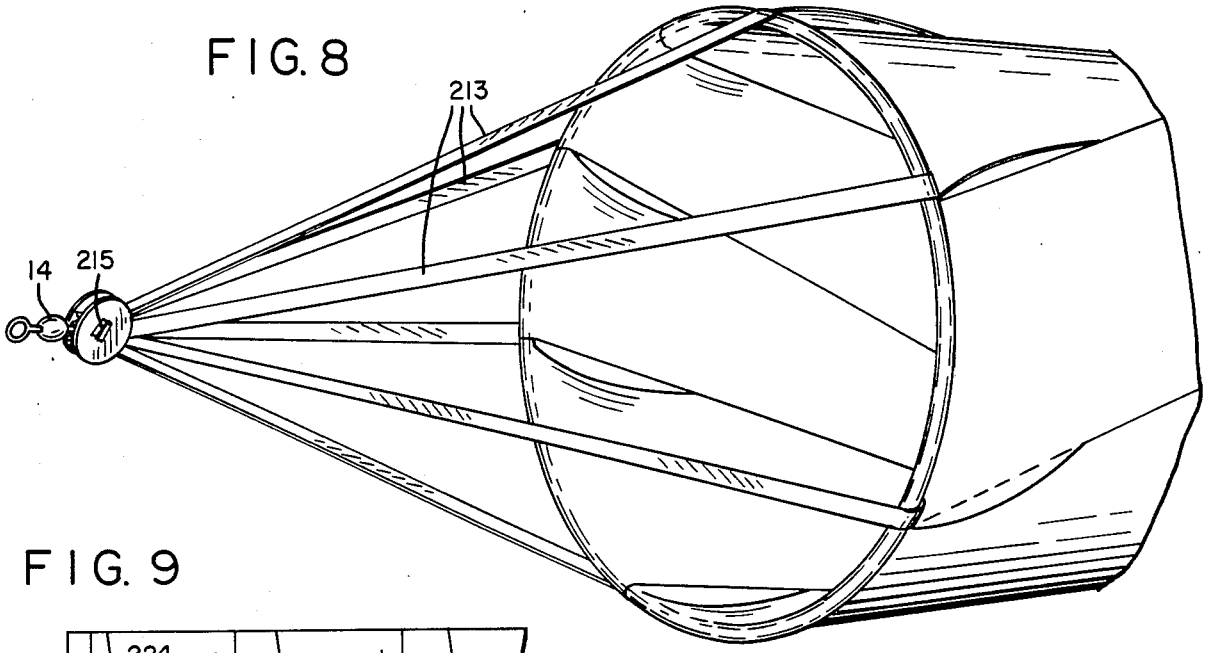
FIG. 8 is a view, on an enlarged scale, of the mouth and bridle portion of a modified form of the invention.

An aerial toy of the basket type can also be substantially improved by incorporating in it the integral bridle feature of the present invention. FIG. 8 shows the integral bridle feature, but on a sleeve-type aerial toy. A basket having an integral bridle is formed by utilizing a sheet of flexible material cut as shown in FIG. 9, but having the sections stubbier or more of squat form than shown in FIG. 9 (like the proportions in FIG. 3). The head ends of the sections are fastened to form a mouth such as shown in FIG. 10, with the integral bridles in place and connected at their free ends as shown in FIG. 8. Rather than side seaming the sections, the tail ends of the sections are interconnected by a Swiftach connection such as shown at 215 in FIG. 8.

What is claimed is:

1. An aerial sleeve toy comprising:

a sleeve of flexible material, said sleeve being of circular cross section and tapering from one end to the other, said one end constituting a head end providing an air entry mouth, said other end constituting a tail end for egress of air, the tapering configuration of said flexible sleeve providing for a build-up of air pressure within said sleeve, said head end adapted for a bridle connection for supporting said sleeve for wind passage relative thereto, said sleeve comprising plural strips of substantially the same size extending at least generally longitudinally of said sleeve, each strip being of substantially right triangular form, at least at the head end portion thereof, each strip having a hypotenuse leg, a base leg, and an altitude leg, said strips being disposed annularly in such a side-by-side relationship that, for any pair of adjacent strips, the altitude leg of one strip is in contact with the hypotenuse leg of the other strip, said strips being arranged in such a lengthwise relationship that the head end of the altitude leg of each strip terminates short of the head end of the associated hypotenuse leg, said strips being joined together in the above recited disposition with the junctures terminating short of the head end of each altitude leg to provide a vent between each pair of strips at the head ends thereof, a ring at the head end of said sleeve, means securing the end margins of the head ends of said strips to said ring to thereby form, for each pair of adjacent strips, an airchute at each vent so that air passing therethrough exerts a rotating force on said sleeve in a common circumferential direction.

2. An aerial sleeve toy as recited in claim 1 in which said strips bear a successive offset in an axial direction so that the junctures spiral about the length of the sleeve toy.

3. The method of producing a rotary aerial toy comprising:

providing plural essentially right triangular strips of substantially the same size, each of said strips having a head end and a tail end, seam-securing said strips to one another with the hypotenuse leg of one strip in contact with the altitude leg of an adjacent one of said strips and with the head ends of each of the altitude legs terminating substantially the same distance short of the head ends of the hypotenuse legs, terminating the seam securement short of the head ends of the altitude legs, providing a ring, securing the head ends of said strips to said ring to form airchutes at said head ends between said seam-securement-head-end terminations and said ring.

4. The method of claim 3 wherein the seam securement is terminated short of the tail ends of adjacent strips.

5. The method of claim 3 wherein the ends of the altitude leg of each strip are offset in a downstream direction from the ends of the associated hypotenuse leg prior to seam securement.

6. The method of producing an aerial toy, comprising:

providing plural elongate strips of substantially the same size and shape, said strips each having a head end and a tail end, arranging the strips so that there is a step between the head ends of any selected pair of adjacent strips, seam-securing the strips to one another in an annular arrangement while retaining said steps between the head ends of adjacent strips with the seam securement between adjacent strips terminating short of the head ends of the individual strips of each of said selected pairs, providing a ring, securing the head ends of said strips to said ring to form airchutes at said head ends between said seam-securement-head-end terminations and said ring.

7. An aerial toy comprising:

a sleeve of flexible material, such sleeve being of circular cross section, one end constituting a head end providing an air entry mouth, the other end constituting a tail end, means on said toy for causing a build-up of pressure within said sleeve when it is subject to wind flow, said head end adapted for a bridle connection for supporting said tubular sleeve for wind passage relative thereto, said sleeve comprising plural strips of substantially the same size extending at least generally longitudinally of said sleeve, said strips being arranged annularly in side-by-side relationship, all of said strips being joined together in an annular relationship with each strip being joined with an adjacent strip with the junctures stopping short of the head ends of the strips and with a step being provided at the head end portions of adjacent ones of said strips.

8. An aerial toy as recited in claim 7 in which each strip has means including an interrupt cut defining an integral bridle line, the free ends of said bridle lines being fastened together to provide a juncture for supporting and/or pulling the sleeve.

9. An aerial toy as described in claim 8, in which the free ends of the bridle lines are connected together by a "Swiftach" fastener.

10. An aerial toy as described in claim 9 including a swivel clip having a ring through which said "Swiftach" fastener is connected to said clip.

11. The method of producing a rotary aerial toy comprising:

providing plural essentially right triangular strips of flexible material, said strips each being of substantially the same size and having a head end and a tail end, seam-securing the strips to one another with the hypotenuse leg of each said strip in contact with the altitude leg of an adjacent one of said strips and with the head ends of the altitude legs terminating substantially the same distance short of the head ends of the hypotenuse legs, and terminating the seam securements short of the head ends of the altitude legs so as to leave mutually adjacent margins of the head ends of said altitude legs free of each other.

12. The method of producing a rotary aerial toy comprising:

providing a sheet of flexible material having parallel edges, producing sever lines through said sheet, certain of said sever lines intersecting said edges to divide the sheet into plural mutually discrete sections, other of said sever lines terminating short of at least one of the parallel edges to form integral bridle lines having free ends, said sections having head ends and tail ends, securing the head ends of said sections together to form a mouth for reception of an airstream, said securement being in such a fashion as to leave said bridle lines dangling free except for integral securement at said mouth, otherwise securing said sections together in spaced relation from said mouth to provide structure to cause said aerial toy to rotate when an airstream passes into said mouth, securing the free ends of said bridle lines together to form a bridle.

* * * * *